US005353528A

United States Patent [19]

Demarchi

[11] Patent Number: 5,353,528

[45] Date of Patent: Oct. 11, 1994

[54] ALPINE SKI BOOT WITH AN ENERGY STIRRUP JOURNALLED ON THE REAR SPOILER

[75] Inventor: Jean-Louis Demarchi, Saint-Jorioz, France

[73] Assignee: Salomon S. A., Annecy Cedex, France

[21] Appl. No.: 150,797

[22] Filed: Nov. 12, 1993

Related U.S. Application Data

[63] Continuation of Ser. No. 854,907, Mar. 20, 1992, abandoned.

[30] Foreign Application Priority Data

Mar. 21, 1991 [FR] France ..... 91 03668

[51] Int. Cl.[5] ..... A43B 5/04

[52] U.S. Cl. ..... 36/121; 36/120

[58] Field of Search ..... 36/50.5, 89, 109, 114, 36/117-121, 105, 93, 88, 54

[56] References Cited

U.S. PATENT DOCUMENTS

| | | | |
|---|---|---|---|
| 3,619,914 | 11/1971 | Hanson et al. | 36/121 |
| 3,713,231 | 1/1973 | Mochizuki | 36/121 |
| 4,060,256 | 11/1977 | Collombin et al. | 280/613 |
| 4,078,322 | 3/1978 | Dalebout | 36/121 |
| 4,085,528 | 4/1978 | Delery | 36/121 |
| 4,095,356 | 6/1978 | Robran et al. | 36/121 |
| 4,265,034 | 5/1981 | Salomon | 36/121 |
| 4,565,017 | 1/1986 | Ottieri | 36/117 |
| 4,669,202 | 6/1987 | Ottieri | 36/117 |
| 4,691,454 | 9/1987 | Ottieri | 36/117 |
| 4,897,940 | 2/1990 | Sartor | 36/119 |
| 4,905,385 | 3/1990 | Perrissoud | 36/121 |
| 4,962,594 | 10/1990 | Marega et al. | 36/117 |
| 5,031,341 | 7/1991 | Paris et al. | 36/120 |
| 5,105,566 | 4/1992 | Legon | 36/121 |

FOREIGN PATENT DOCUMENTS

| | | |
|---|---|---|
| 177269 | 1/1986 | European Pat. Off. . |
| 350023 | 1/1990 | European Pat. Off. . |
| 380444 | 8/1990 | European Pat. Off. . |
| 3530243 | 3/1987 | Fed. Rep. of Germany . |
| 2096248 | 2/1972 | France . |
| 2305948 | 10/1976 | France . |
| 2330345 | 6/1977 | France . |
| 2619684 | 3/1989 | France . |
| 375526 | 4/1964 | Switzerland . |
| 491619 | 7/1970 | Switzerland . |
| 512204 | 10/1971 | Switzerland . |

*Primary Examiner*—Paul T. Sewell
*Assistant Examiner*—Thomas P. Hilliard
*Attorney, Agent, or Firm*—Sandler, Greenblum & Bernstein

[57] ABSTRACT

Ski boot having a rigid shell base surmounted with an upper including at least one front portion and one rear portion that are fastened, via at least a tightening system of the upper, on the lower part of the leg, and a flexion control device, both of amplitude and of force in the frontward direction located on the rear portion of the upper. The flexion control device includes an energy stirrup that is flexible and connected in a pivotable manner to the rear portion of the upper, this rear portion being pivotable on the shell base. The stirrup has at least one abutment adapted to cooperate with a complementary abutment obtained on the shell base when the upper is closed on the lower part of the leg of the skier in the skiing position.

18 Claims, 6 Drawing Sheets

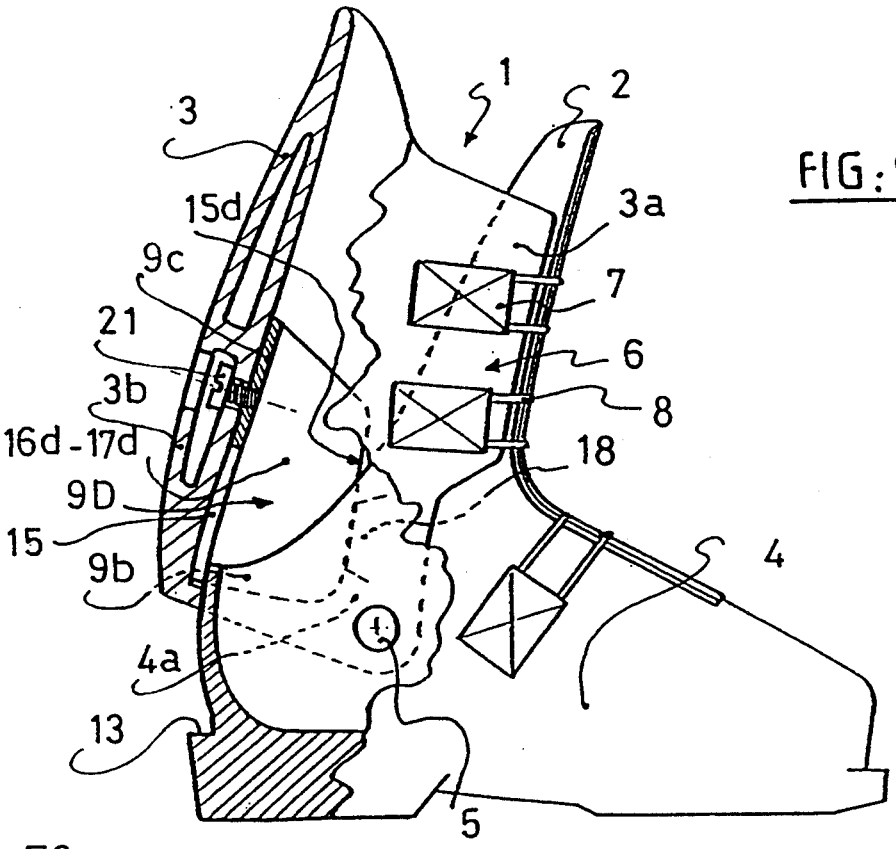
FIG:9
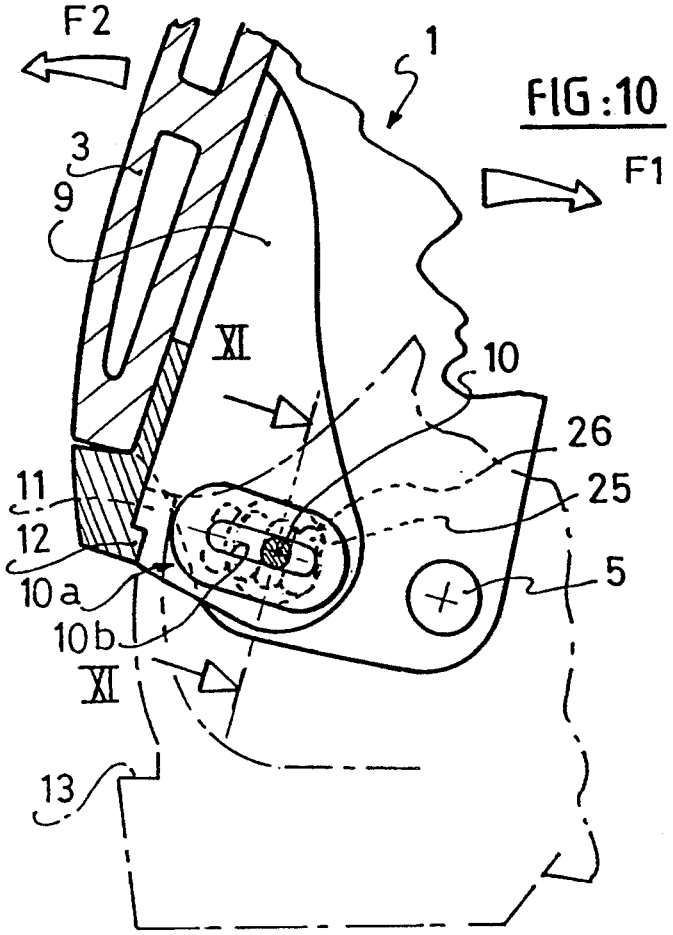
FIG:10
FIG:11
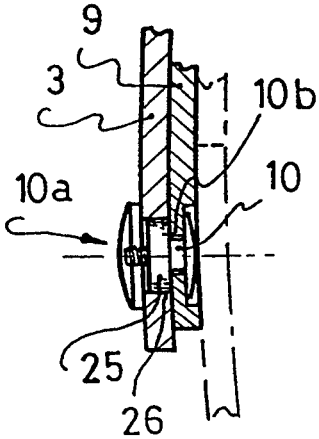

ALPINE SKI BOOT WITH AN ENERGY STIRRUP JOURNALLED ON THE REAR SPOILER

This application is a continuation of application Ser. No. 07/854,907, filed Mar. 20, 1992, now abandoned.

BACKGROUND OF THE INVENTION

1. Field of the Invention

The present invention relates to an alpine ski boot having a rigid shell whose shell base is surmounted with an upper that is at least partially journalled on the latter about a transverse axis, the upper comprising at least one front portion and one rear portion or rear spoiler, in the open position to enable passage of the foot, a closure assembly for the upper forming a collar on the lower part of the leg, comprising a tightening system at least partially encircling the upper in order to be tensioned by a tensioning lever fixed on one of the component parts of the upper, the flexion control means of amplitude of movement and magnitude of force flexion in the frontward direction being located on a rear portion of the upper.

2. Description of Background and Relevant Information

Various solutions have already been proposed in order to obtain such flexion control means.

Particularly, European Patent Application No. 350,023 describes a ski boot whose shell base comprises an extension constituting two symmetrical portions separated by an indent at the rear defining two lips, whereas in the front portion, the extension is constituted by two plates that intersect by overlapping.

Such a boot is especially adapted for insertion of the foot from above and includes an anti-rocking means towards the rear obtained in the form of an abutment, arranged at the upper portion of the heel.

The adjustment of the front flexion, both of amplitude and force, is in fact accomplished by modifying the position of a cursor between the two lips of the rear indent, the cursor being adjustable in translation by means provided with screws.

The control and adjustment device for front flexion here is arranged on an element, in fact the rear extension of the shell base, obtained by molding in an integral piece, from a single material. It thus becomes necessary to choose a material that has, simultaneously, both the resistance qualities required by the shell base, as well as the relative elasticity required by the extension of the shell base. It therefore becomes difficult, due to these reasons, to find an ideal compromise to obtain a shell whose base is comfortable and whose upper portion is elastically reliable.

Moreover, such a technique also leads to demolding difficulties, that are basically due to the height of the extensions and to the overlapping to be obtained in the front portion.

Also, this type of boot, because of this construction, is difficult to put on because its entire upper portion must be removed in order to introduce the foot, even more so because the collar is blocked in its front-to-rear position as explained above.

In order to remedy this lack of rear opening in the boot, a Swiss Patent No. 375,526 is also known, which discloses an alpine ski boot with rear entry of the foot and in which the angular bottoming of the rear spoiler, one of the component elements of the upper, is limited in the frontward direction by a retention element that is built to project at the lower portion of the rear spoiler, and cooperates with an edge of the heel on the shell base.

It is easy to understand that such means for limiting flexion would not be exact because they only limit overall flexion, and do not provide any specific control for frontward movements.

SUMMARY OF THE INVENTION

An object of the present invention is to overcome these disadvantages, and to this end, the present invention is related to an alpine ski boot comprising a rigid shell whose shell base is surmounted with an upper, at least partially journalled on the latter about a transverse axis, and comprising at least one front portion and one rear portion or rear spoiler, to enable the passage of the foot in the open position, a closure assembly of the upper forming a collar on the lower part of the leg, being constituted by a tightening system at least partially encircling the upper in order to tension it via a tensioning lever fixed on one of the front and rear component parts of the upper, flexion control means of the amplitude and the force in the frontward direction being done on the rear portion of the upper, wherein the flexion control means of the amplitude and force are constituted by an energy stirrup affixed to the rear portion of the upper, positioned between the latter and the shell base and capable of being driven pivotably by the rear portion with respect to the shell base, in a movement directed in the rear-to-front direction, along a path demarcated by a fixed abutment zone arranged on the shell base at its upper portion adapted to cooperate with a complementary movable abutment zone of the stirrup when the upper is closed on the lower part of the leg of the skier in the skiing position.

According to one variation of the invention, the abutment zones cooperate with each other after a free pivoting along a predetermined angle of the upper with respect to the shell base, corresponding to a start of flexion control of the upper, by means of the reaction of the energy stirrup against the rear portion of the upper.

According to this characteristic, it is easy to understand that the flexibility of the energy stirrup can be specifically controlled because of its independence, and as far as manufacture is concerned, it enables the use of specific materials preferably having very good qualities of elasticity. Moreover, because of the small volume of this element, the choice of a more expensive material does not adversely affect the manufacturing costs of the boot.

According to another characteristic of the invention, the energy stirrup pivots upon being driven by the rear portion of the upper in a rear-to-front or front-to-rear direction, along a path of the abutment zone of the stirrup, demarcated respectively by the upper abutment zone of the shell base acting in the rear-to-front direction, corresponding to the start of flexion control, and by a fixed lower abutment zone of the shell base corresponding to a lower rear portion of the heel, the fixed upper and lower abutment zones of the shell base being distanced angularly according to a predetermined angle, corresponding to an angle of maximum opening of the rear portion of the upper to enable the boot to be put on.

BRIEF DESCRIPTION OF THE DRAWINGS

Other characteristics will become apparent upon reading the description that follows, given as an example only, and will enable a better understanding of how the invention can be implemented with respect to the annexed drawings in which:

FIGS. 8, 9, 10 and 11 are side views and partial section views of the boot according to other variations of the embodiment of the flexion control means.

DETAILED DESCRIPTION OF PREFERRED EMBODIMENTS

Figure 1:
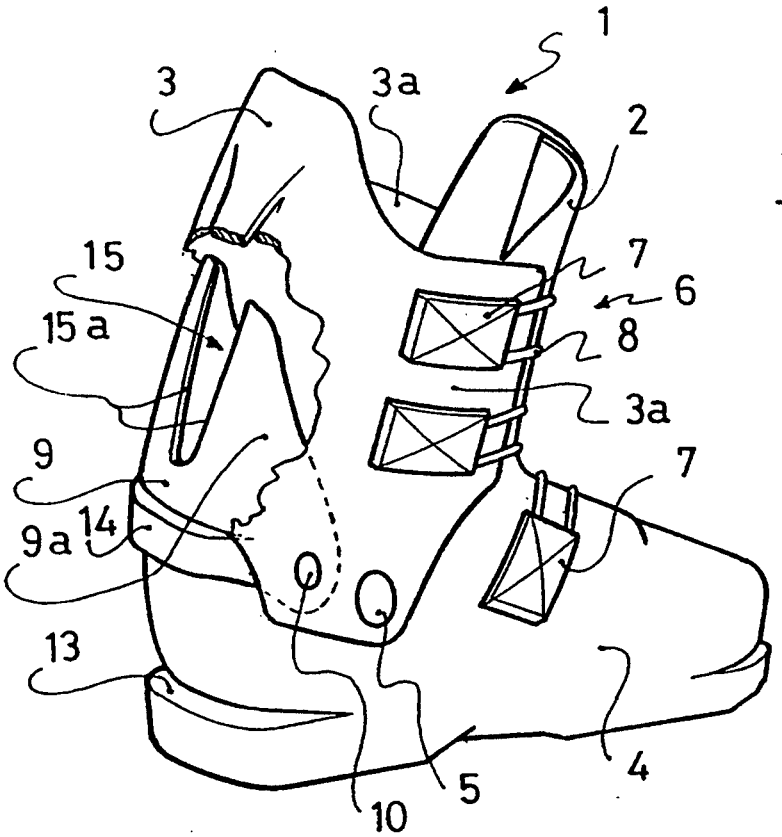
FIG. 1 is a perspective view of the ski boot, partially sectioned in its rear zone provided with flexion control means according to the invention.

The boot represented in FIGS. 1–11 is of the rear entry type, but this is given as a non-limiting example.

According to the invention, the ski boot has an upper 1 comprising a frontal front portion 2, a rear portion 3 and a shell base 4 on which the rear portion 3 of upper 1 is connected at a transverse journal axis by means of laterally oppositely disposed fasteners, such as rivets or axles 5.

The boot represented also comprises several tightening systems 6 and systems of closure of upper 1 on the lower part of the leg of the skier, each comprising, in a known manner, a tensioning lever 7 that fastens by tensioning a flexible link such as a cable buckle 8 partially surrounding the frontal portion 2 of upper 1 so as to link each tensioning lever 7 fixed on a wing 3*a* of the rear portion 3 or rear spoiler to anchoring points (not represented) arranged on the other wing 3*a* of the same portion 3, and encompassing the frontal portion 2 in its passage, with a view to bringing them together.

According to the invention, the boot comprises flexion control means of amplitude and force in the frontward direction, that are obtained on the rear portion 3 of upper 1.

As is represented in FIGS. 1–4, these means are constituted by an energy stirrup 9 in the shape of a shell whose two lateral wings 9*a* at least partially overlap shell base 4, in its rear portion, this stirrup 9 itself being brushed by the lateral wings 3*a* of the rear portion 3 of upper 1 against which it is pressed fixedly to be driven by pivoting with respect to the shell base 4, in a rear-to-front or front-to-rear movement about two axes by means of laterally oppositely disposed fasteners, such as rivets or axles 10 located at the rear, behind the transverse journal axis of axles 5 of the rear portion 3 of the upper 1 on shell base 4. These axles 10 constitute links between wings 9*a* of stirrup 9 and wings 3*a* of rear portion 3 of upper 1 which are thus affixed to each other.

In a rear-to-front movement, when upper 1 is closed on the lower part of the leg (FIG. 3), the energy stirrup 9 is driven pivotably by rear portion 3, to which it is affixed by the above-mentioned axles 10, along a path demarcated by an abutment 11 arranged on shell base 4 at its upper portion in the area of the heel.

The abutment 11 cooperates with a complementary abutment 12 of stirrup 9 after a free pivoting according to a predetermined angle of upper 1, and more specifically of the rear portion 3 with respect to shell base 4.

Figure 4:
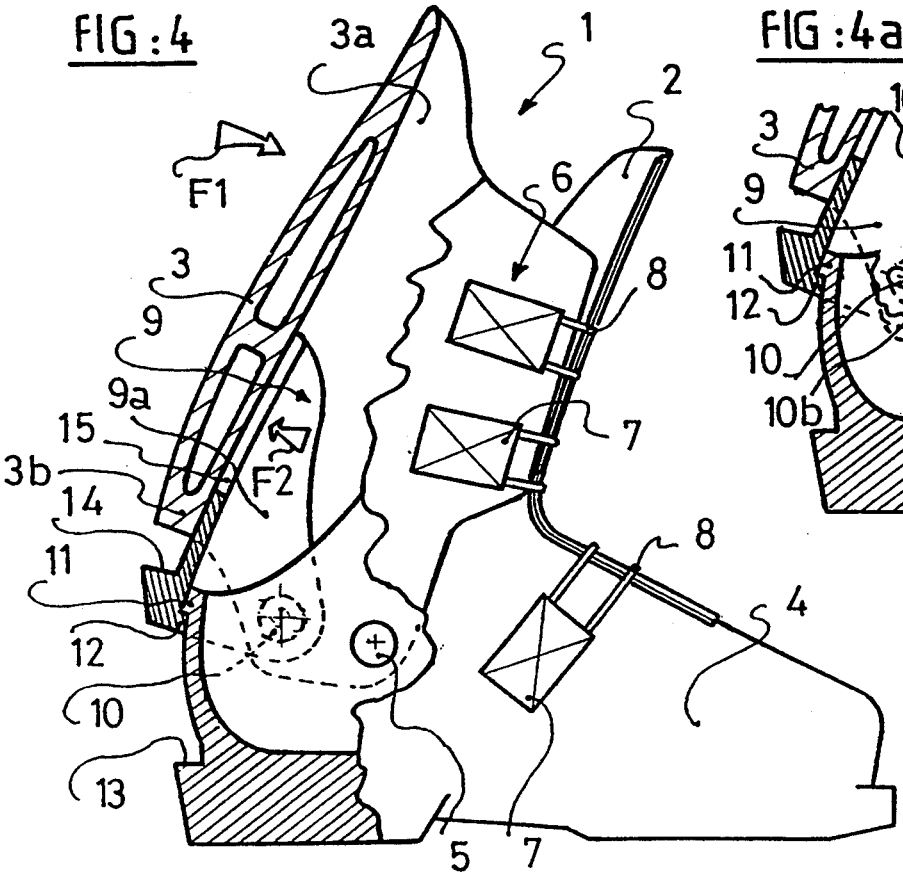

From this position, where abutments 11 and 12 cooperate with each other, the flexion control of upper 1 starts, this flexion being done in the direction F1, by the reaction of stirrup 9 in the inverse direction F2 against the rear portion 3 of upper 1 (FIG. 4).

Figure 4A:
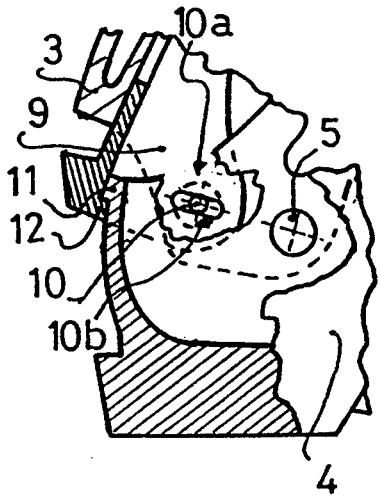
FIG. 4*a* represents a detail of the embodiment of the flexion control means of the boot illustrated in FIGS. 1–4.

This reaction of stirrup 9 is brought about by the pivoting of rear portion 3 of upper 1 in the rear-to-front direction, the pivoting generating the pivoting of stirrup 9 in the front-to-rear direction because the latter is retained against abutment 11 and because of its connection by axles 10 with the rear portion 3. As is clear, to enable the pivoting of stirrup 9 in the front-to-rear direction, the adjustment of stirrup 9 with rear portion 3 of shell base 4, which is provided with abutment 11, is provided in a relatively free manner, for example, with the relative clearances between the abutment 11 and complementary abutment 12 and/or between the connection axles 10 and at least stirrup 9 or the rear portion 3 of upper 1. It is also possible, as has been illustrated schematically in FIG. 4*a*, to provide a link 10*a* between stirrup 9 and the rear portion 3 of upper 1, the link being mobile in translation with respect, at least, to journal axles 5 or to abutment 11, which are fixed in position on the shell base 4. In the present case, the link 10 is established by means of a connection axles 10 which is positioned in a fixed manner on the rear portion 3 of upper 1 and which cooperates with an oblong slot 10*b* obtained in the energy stirrup 9 in which it may slide.

Abutments 12 and 11 are respectively obtained in the lower portion 9*b* of energy stirrup 9 and in the rear upper zone of shell base 4 corresponding to the heel, and constitute projections of complementary shapes approximately at right angles but oriented in opposite directions in the manner of a spade head, in order to be buttressed on another by mutual support.

As is also shown in FIGS. 1–4, the energy stirrup is also capable of pivoting in a front-to-rear direction along a path of abutment 12 of stirrup 9, limited by a lower abutment 13 of shell base 4 corresponding to a rear lower portion of the heel, such as for example the upper edge of the sole of the boot.

This lower abutment 13 is constituted by a horizontal shoulder obtained during molding of shell base 4.

Figure 2:
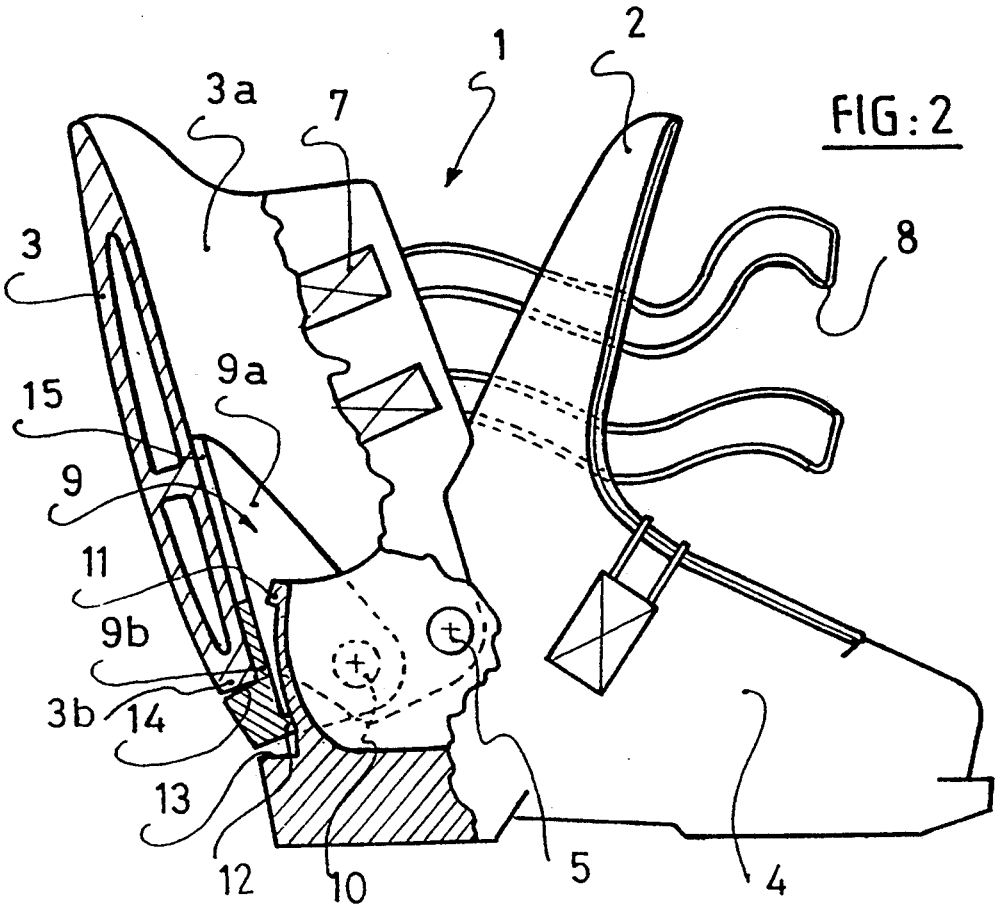
FIGS. 2, 3 and 4 are partial sectional side views of a boot according to FIG. 1, respectively showing the boot in an open, in a closed and in a front flexion position.
Figure 3:
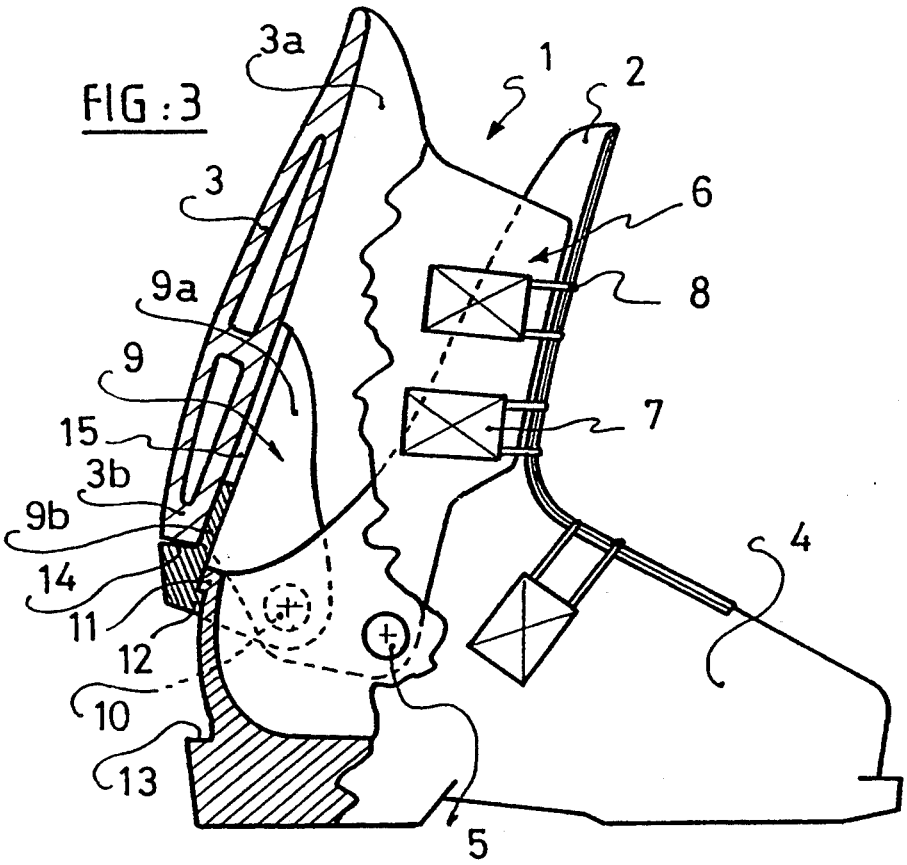

Abutments 11 and 13, respectively at the upper and lower abutments of shell base 4 that are thus defined, are distanced angularly with respect to the axis of axles 5 along a certain angle that substantially defines the maximum opening angle of the rear portion 3 of upper 1 with a view to putting the boot on (FIG. 2).

In order to enable the energy stirrup 9 to be driven at least in the front-to-rear direction of the rear portion 3 of upper 1, an edge 14 is made to project towards the outside at the lower portion 9*b* of the stirrup 9 constituting a support shoulder of the rear portion 3 of upper 1, during opening of the latter.

The energy stirrup 9 also comprises at its rear portion, substantially in its medium zone, a vertical scallop or slot 15 opened in a flared manner upwardly in this example, adapted to be deformed by the coming together of the lips of edge 15*a* during front flexion. The slot 15 is directed opposite the affixing means 10 constituted by the axles of stirrup 9 acting in the lower zone 3*b* of the rear portion 3 of upper 1. Stirrup 9 is then blocked during frontward pivoting on the upper abutment 11 of shell base 4, and from this moment onwards, the rear portion 3 biases stirrup 9 in front flexion which, by a resistance effect, is elastically deformed by the simultaneous coming together of lips 15*a* of scallop 15 and their buckling.

In the embodiment described above, because axles 10 of stirrup 9 are arranged at the rear with respect to the transverse axis of axles 5 of the rear portion 3 on shell base 4, this has the advantage of not necessitating a close contact between stirrup 9 and the inside of rear portion 3 of upper 1, and enables a lack of energy at the start of flexion, due to the clearance to be avoided. In fact, because of the position of the axis of axles 10 of energy stirrup 9 with respect to the axis of axles 5, as soon as abutments 11, 12 respectively of shell base 4 and stirrup 9 are placed in contact, a rocking of the latter towards the rear is obtained, advantageously bringing about an immediate backlash elimination that may exist between the stirrup 9 and rear portion 3 of upper 1.

Figure 5:
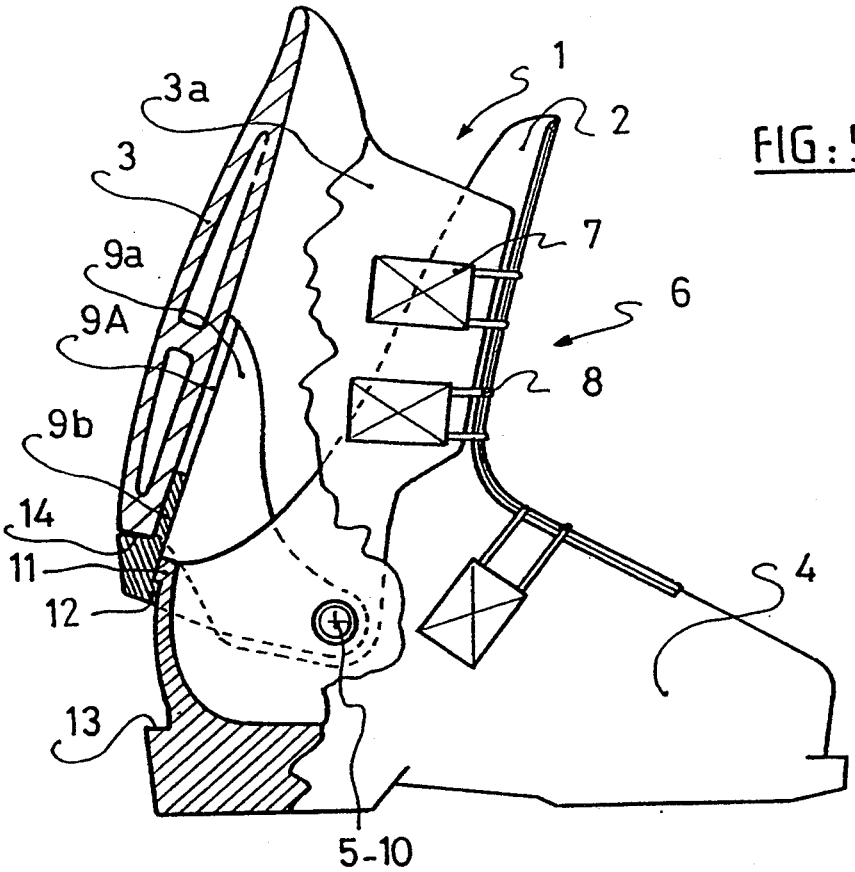
FIG. 5 is a side view and a partial section of a boot according to a variation of the embodiment of the flexion control means.

A variation of the embodiment represented in FIG. 5 basically differs from the previous embodiments in that the energy stirrup 9A pivots, with respect to shell base 4, about a connection axis that is the same as the transverse journal axis of axles 5 of the rear portion 3 of upper 1, corresponding substantially to the malleoli, and this is done in order to simplify the embodiment.

Figure 6:
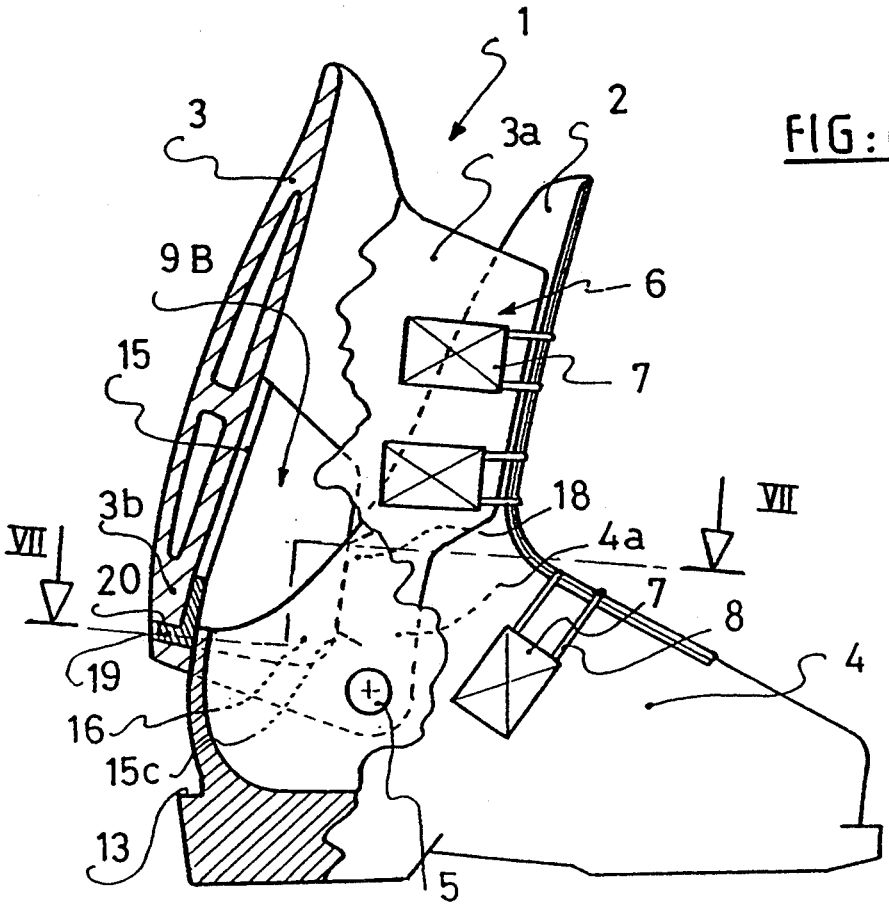
FIG. 6 is a side view and a partial section of the boot according to another variation of the embodiment of the flexion control means.
Figure 7:
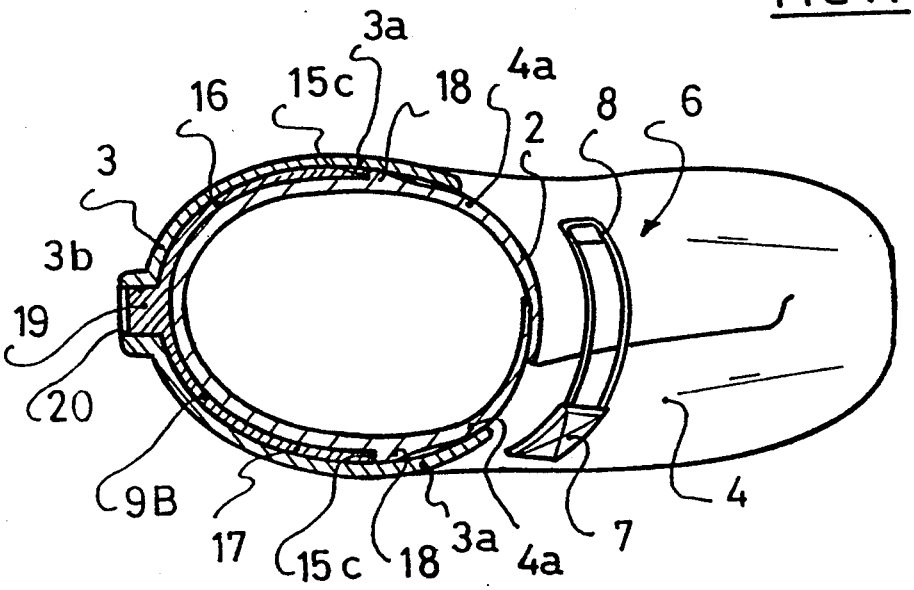
FIG. 7 is a sectional view along line VII—VII of the boot represented in FIG. 6.

According to another variation of the embodiment represented in FIGS. 6 and 7, the abutment of energy stirrup 9B is constituted by the extreme edge portions 15*c* of each of its wings 16, 17 adapted to cooperate with the upper abutment zone of shell base 4, which, as a matter of fact, comprises two complementary shoulders 18 obtained on lateral wings 4*a* of shell base 4 linked to edge portions 15*c* of wings 16, 17 of the energy stirrup 9B.

Also, according to the embodiment represented in FIGS. 6 and 7, energy stirrup 9B is affixed to the rear portion 3 of upper 1, whether it be in the front-to-rear or in the rear-to-front direction, by means of a projection or pin 19 engaged in a corresponding indent 20 provided in the lower zone of the rear portion 3 of upper 1.

In this way, the follow up of stirrup 9*b* is improved with respect to the rear portion 3 of upper 1.

Figure 8:
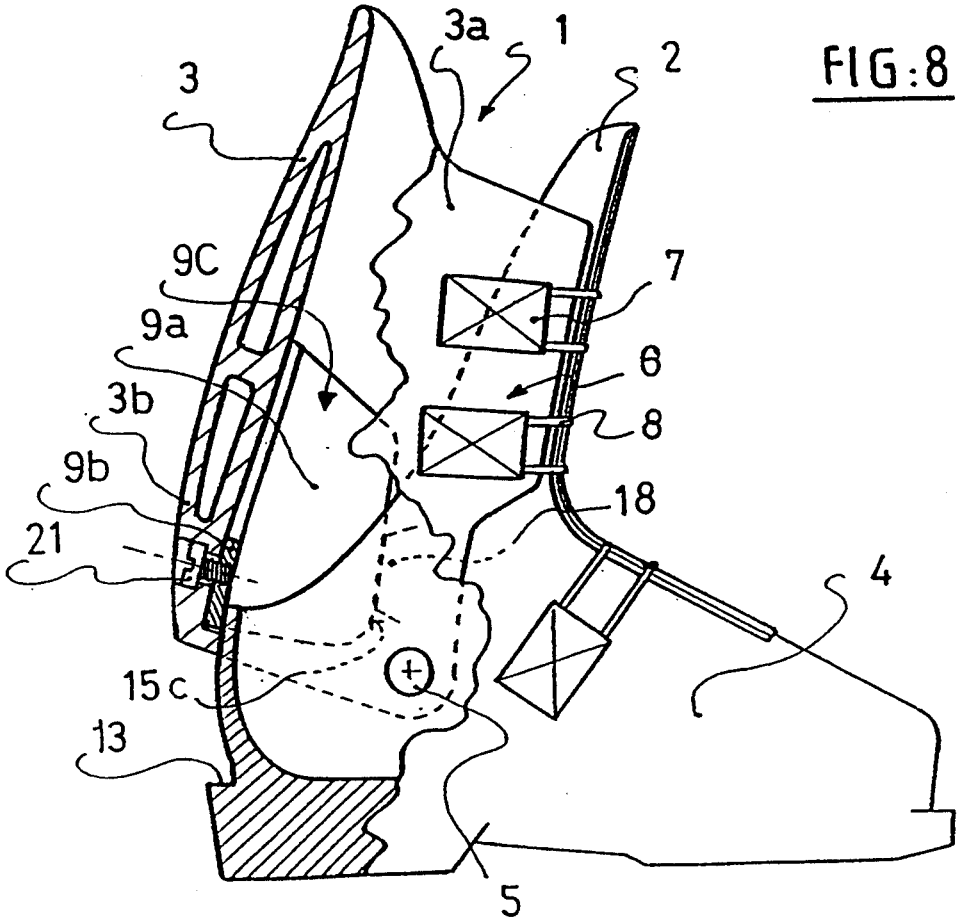

According to another variation of the embodiment represented in FIG. 8, energy stirrup 9C is affixed to the rear portion 3 of upper 1, in the front-to-rear or rear-to-front direction by means of an effective assembly means, for example a screw 21 connecting the lower zones 9*b*, 3*b* respectively of stirrup 9C and the rear portion 3 of upper 1.

As has been described with reference to the above-mentioned FIGS. 1–8, energy stirrup 9 is provided with a vertical scallop 15 opened upwardly to improve its flexibility and to localize its deformable zones. It is to be understood that the stirrup may also be provided to be deformable in its entirety. In this case, the deformable zones are located simply in a more or less random manner on wings 9*a* and on the medium portion of energy stirrup 9.

Also, energy stirrup 9 may also be provided to function with even more flexion in the lower portion, contrary to the previous embodiments. To this end, for example, as has been represented in FIG. 9, energy stirrup 9D is affixed to the rear portion 3 of upper 1 in its upper zone 9*c* and its vertical scallop or slot 15 is open downwardly in its lower zone 9*b*. In the present construction, the abutment of energy stirrup 9D is constituted by the extreme edge portions 15*d* of each of its wings 16*d*, 17*d* that cooperate with the upper abutment zone of shell base 4 such as two shoulders 18 obtained on the lateral wings 4*a* of the latter. It is understood that energy stirrup 9D may be linked at the rear portion 3 of upper 1 by means of different assembly means that may, for example, be a screw 21 or a pin 19—indent 20 assembly as illustrated in FIGS. 6 and 7.

In a variation of the embodiment of the invention illustrated in FIGS. 10 and 11, stirrup 9 and rear portion 3 of upper 1 are connected to each other by means of a movable link 10*a* in which fasteners or axles 10 are adjustable on the rear portion 3 in their relative position between journal axles 5 and abutment 11. To this end, in this constructional example, each axle 10 is provided with a serrated shoulder 25 adapted to cooperate with an oblong slot 26 with serrated edges obtained in the rear portion 3 of the upper. This arrangement of link 10*a* thus enables the relation of the lever arms determined by the position of axis of axes 10 with abutment 11 and the journal axis of axes 5 to be varied, and intrinsically, also, the pivot amplitude imposed on stirrup 9 by upper 1, when the rear portion 3 of the upper flexes in the direction F1. The result of such an embodiment is that flexion control, from a stirrup 9 and a rear portion 3 of a given upper, may be modified both in amplitude and in force.

It is to be understood that variations of construction may be implemented without departing from the scope of the invention. One can especially associate with energy stirrup 9, a specific adjustment device or means for its flexibility, independently of the arrangement of a link 10*a* adjustable in position such as the one that has been described in FIGS. 10 and 11 previously. The adjustment means or device (not represented) is for example, a cursor mounted slidably in the vertical slot 15 of energy stirrup 9.

Figure 12:
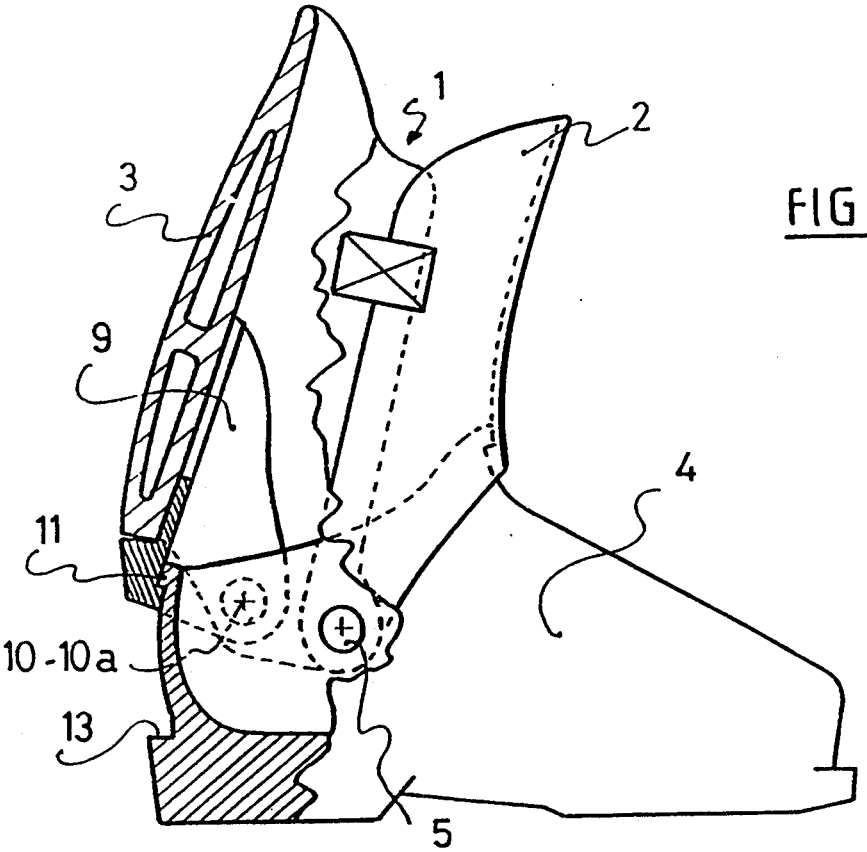
FIGS. 12 and 13 are side views of other types of boots, FIG. 12 representing a boot whose frontal portion of the upper is journalled on the shell base, and FIG. 13 illustrating a top entry type of boot.
Figure 13:
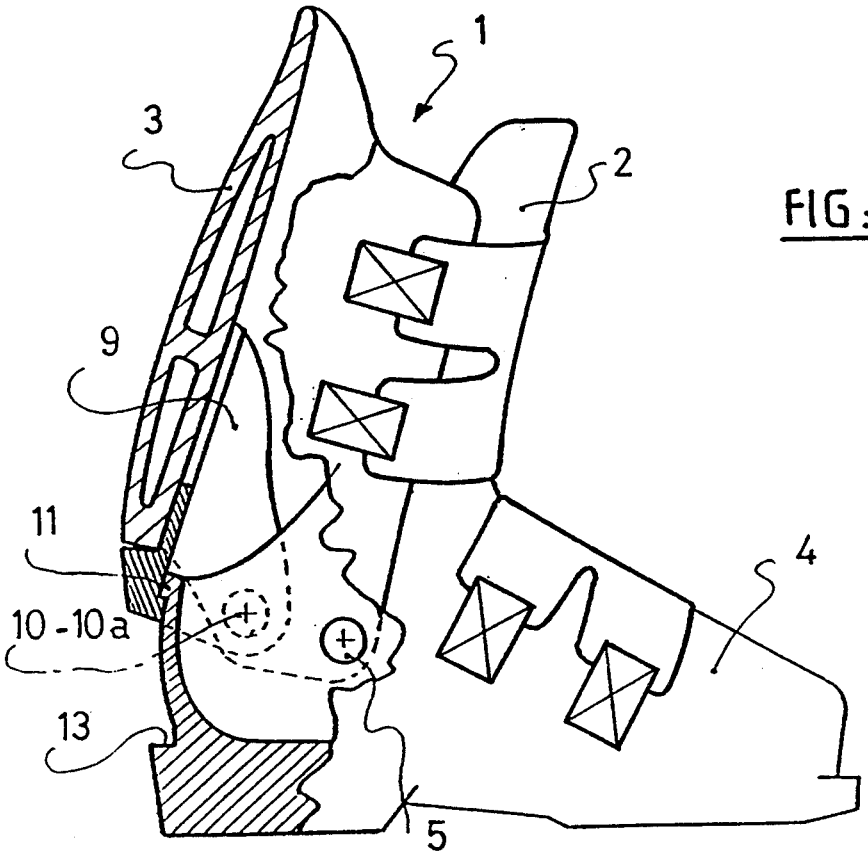

Finally, in the description of the invention with respect to FIGS. 1–11, the boot illustrated as an example, is of the rear entry type. It is clear that the invention is not limited to such a boot and may be related to a boot of the "mixed entry" type, FIG. 12, of the "top entry" type, FIG. 13. In these boots, stirrup 9 is mounted on rear portion 3 of upper 1 in the same way as in the preceding examples, and thus enables flexion of the rear portion 3 of the upper in a frontward direction to be controlled, both in amplitude and in force. It is clear that energy stirrup 9 alone may, according to the desired behavior of the boot, ensure flexion control of upper 1 of the boot. Also, stirrup 9 may be associated to another flexion control device or means of a known type, that acts in the area of the frontal portion 2 of upper 1 with respect to shell base 4. The forces resisting flexion of upper 1 in a frontward direction are then distributed between rear portion 3 of the latter that tends to pull the lower part of the leg of the skier towards the rear, and between the frontal portion 2 that tends to push the lower part of the leg.

Advantageously, and whatever the embodiment chosen, energy stirrup 9, 9A, 9B, 9C may be obtained by molding a plastic material in an integral manner.

The instant application is based upon French patent application 91.03668 of Mar. 21, 1991, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. A ski boot comprising:

a rigid shell base;

an upper;

means for mounting said upper for at least limited pivotal movement about a first transverse axis with respect to said shell base to an open position of the boot to enable insertion of a foot of a skier in said open position;

said upper comprising at least one front portion and at least one rear portion;

a closure assembly for closing said upper on the lower leg of a skier, said closure assembly comprising a tightening system at least partially encircling said upper, said tightening system including a tensioning lever fixed on at least one of said front portion of said upper and said rear portion of said upper; and a flexion control device, for both flexion amplitude of movement and flexion magnitude of force, said flexion control device comprising:

a stirrup affixed to said rear portion of said upper between said upper and said shell base;

means for enabling said rear portion of said upper to drive said stirrup pivotally in a forward direction with respect to said shell base along a path delimited, at an uppermost point, by an upper fixed abutment area of said shell base in cooperation with a complementary movable abutment area of said stirrup in a closed position of the boot, whereby in said closed position of the boot, said upper is directed against the lower leg of a skier; and means for mounting said stirrup for journalled pivotal movement on said rear portion of said upper about a second transverse axis, said second transverse axis being rearwardly spaced from said first transverse axis.

2. A ski boot in accordance with claim 1, wherein:

said fixed abutment area of said shell base comprises a projecting edge provided in an upper portion of said shell base in a heel area of said shell base;

said movable abutment area of said stirrup comprises a edge provided in a lower portion of said stirrup, projecting in an opposite direction to a direction in which said projecting edge of said fixed abutment area projects; and said projecting edge of said movable abutment area and said projecting edge of said fixed abutment area comprise complementary shapes for mutual engagement in said closed position of said boot.

3. A ski boot in accordance with claim 1, wherein:

said rear portion of said upper comprises laterally opposed wings; and said stirrup comprises laterally opposed wings extending beneath said laterally opposed wings of said rear portion of said upper, said laterally opposed wings of said rear portion of said upper thereby overlapping said laterally opposed wings of said stirrup.

4. A ski boot in accordance with claim 1, wherein:

each of said laterally opposed wings of said stirrup comprises at least one extreme edge;

said shell base comprises at least one shoulder;

said abutment area of said stirrup comprises at least one extreme edge of said wings of said stirrup; and said abutment area of said shell base comprises at least said one shoulder for engagement with said at least one extreme edge of said wings of said stirrup.

5. A ski boot in accordance with claim 3, wherein:

said means for mounting said stirrup further comprises means for connecting said laterally opposed wings of said stirrup to said laterally opposed wings of said rear portion of said upper.

6. A ski boot in accordance with claim 1, wherein:

said uppermost point of said path, in which said movable abutment area of said stirrup is in engagement with said upper fixed abutment area of said shell base defines a beginning of flexion control of said boot in a forward direction;

said shell base further comprises a lower fixed abutment area spaced beneath said upper fixed abutment area of said shell base by a predetermined distance;

said ski boot further comprises means for enabling said rear portion of said upper to drive said stirrup pivotally in a rearward direction with respect to said shell base along said path delimited, at a lowermost point, by a lower fixed abutment area of said shell base in cooperation with said movable abutment area of said stirrup in an open position of the boot; and said predetermined distance defines an angle of maximum opening of said rear portion of said upper for permitting a foot to be inserted into the boot.

7. A ski boot in accordance with claim 6, wherein:

said means for enabling said rear portion of said upper to drive said stirrup pivotally in a rearward direction comprises:

a rearwardly projecting edge on a lower portion of said stirrup; and a lower portion of said rear portion of said upper positioned for engagement with said edge of said stirrup during pivotal movement of said rear portion of said upper in said rearward direction.

8. A ski boot in accordance with claim 1, further comprising:

means for affixing said stirrup to said rear portion of said upper during pivotal movement in a forward direction and in a rearward direction, said means for affixing comprising a projection in one of said stirrup and said rear portion of said upper and a complementary recess in the other of said stirrup and said rear portion of said upper.

9. A ski boot in accordance with claim 1, further comprising:

means for affixing said stirrup to said rear portion of said upper during pivotal movement in a forward direction and in a rearward direction, said means for affixing comprising a fastener extending from a portion of said stirrup and a portion of said rear portion of said upper.

10. A ski boot in accordance with claim 1, wherein:

said stirrup comprises an upwardly open slot in a rear portion of said stirrup.

11. A ski boot in accordance with claim 1, wherein:

said stirrup comprises a downwardly open slot in a rear portion of said stirrup.

12. A ski boot in accordance with claim 1, wherein:

said stirrup includes a unitary portion; and said unitary portion comprising means for limiting relative movement, in an opening direction of the boot, between said rear portion of said upper and said stirrup.

13. A ski boot in accordance with claim 5, wherein:

said means for connecting said laterally opposed wings of said stirrup to said laterally opposed wings of said rear portion of said upper comprises a pair of laterally opposed fasteners which connect respective pairs of said laterally opposed wings of said stirrup and rear portion of said upper.

14. A ski boot in accordance with claim 8, wherein:

said projection is provided on said stirrup and said complementary recess is in said rear portion of said upper.

15. A ski boot in accordance with claim 9, wherein:

said fastener comprises a screw.

16. A ski boot in accordance with claim 1, wherein:

said stirrup consists of a unitary piece of material.

17. A ski boot in accordance with claim 1, wherein:

said movable abutment area of said stirrup comprises a unitary projection at a lower end of said stirrup.

18. A ski boot comprising:

a rigid shell base;

an upper;

means for mounting said upper for at least limited pivotal movement about a first transverse axis with respect to said shell base to an open position of the boot to enable insertion of a foot of a skier in said open position;

said upper comprising at least one front portion and at least one rear portion;

a closure assembly for closing said upper on the lower leg of a skier, said closure assembly comprising a tightening system at least partially encircling said upper, said tightening system including a tensioning lever fixed on at least one of said front portion of said upper and said rear portion of said upper; and a flexion control device, for both flexion amplitude of movement and flexion magnitude of force, said flexion control device comprising:

a stirrup affixed to said rear portion of said upper between said upper and said shell base;

means for enabling said rear portion of said upper to drive said stirrup pivotally in a forward direction with respect to said shell base along a path delimited, at an uppermost point, by an upper fixed abutment area of said shell base in cooperation with a complementary movable abutment area of said stirrup in a closed position of the boot, whereby in said closed position of the boot, said upper is directed against the lower leg of a skier; and means for mounting said stirrup for journalled pivotal movement on said rear portion of said upper in a forward direction about a second transverse axis, said second transverse axis being rearwardly spaced from said first transverse axis;

said stirrup being affixed to said rear portion of said upper so that flexional movement of said stirrup in a forward direction is caused by engagement of said movable abutment area of said stirrup with said fixed abutment area of said shell base in said closed position of said boot.

* * * * *